US005846145A

United States Patent [19]

Tinlin

[11] Patent Number: 5,846,145

[45] Date of Patent: Dec. 8, 1998

[54] VACUUM LYSIMETER GOLF CLUB HANDLE

[76] Inventor: Richard M. Tinlin, P.O. Box 1282, Camp Verde, Ariz. 86322

[21] Appl. No.: 955,253

[22] Filed: Oct. 21, 1997

Related U.S. Application Data

[60] Provisional application No. 60/036,984 Jan. 30, 1997.

[51] Int. Cl.[6] ..... A63B 49/08

[52] U.S. Cl. ..... 473/550

[58] Field of Search ..... 473/549, 550, 473/300, 303

[56] References Cited

U.S. PATENT DOCUMENTS

| | | | |
|---|---|---|---|
| 2,960,133 | 11/1960 | Shepherd, Jr. | 473/300 X |
| 4,139,195 | 2/1979 | Dreesen et al. | 473/550 |
| 4,407,500 | 10/1983 | Hofmann | 473/550 |
| 4,890,848 | 1/1990 | Hayes et al. | 473/550 |
| 5,355,552 | 10/1994 | Huang | 473/300 X |
| 5,397,123 | 3/1995 | Huang | 473/550 |
| 5,571,051 | 11/1996 | Huang | 473/550 X |
| 5,669,835 | 9/1997 | Tiura | 473/550 |

*Primary Examiner*—William E. Stoll
*Attorney, Agent, or Firm*—Gregory J. Nelson

[57] ABSTRACT

A grip for a sports racquet, tool or other article adapted to be hand-held when in use. The grip defines an internal vacuum chamber which communicates with ambient surroundings through one or passageways in the grip. The passageways are covered or filled with a porous, permeable material. A port with removable plug communicates with the internal vacuum chamber. When, the grip is wetted and a vacuum applied to the chamber, moisture that accumulates on the surface of the grip will be drawn by a wicking action into the chamber to maintain the grip in a substantially dry condition.

14 Claims, 2 Drawing Sheets

FIG. 1
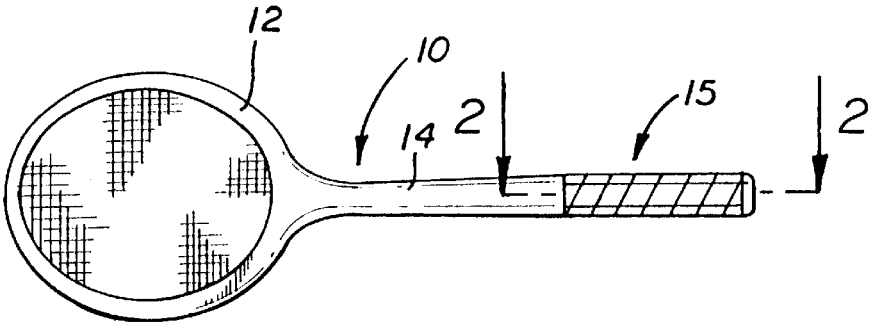
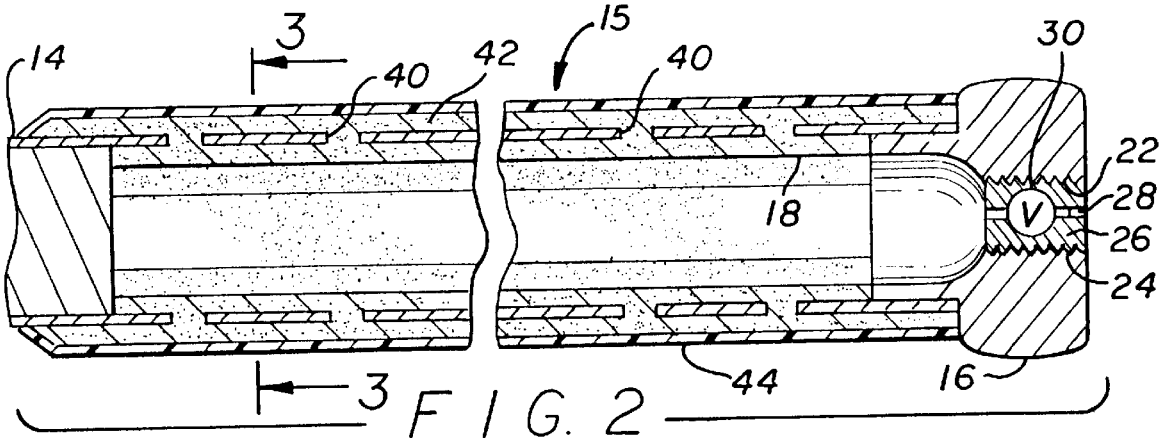
FIG. 2
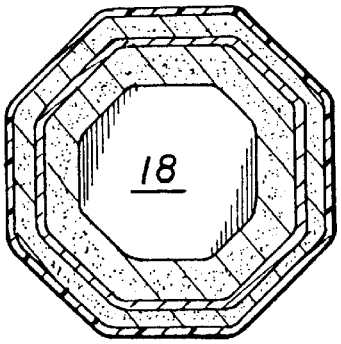
FIG. 3
FIG. 6
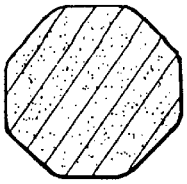
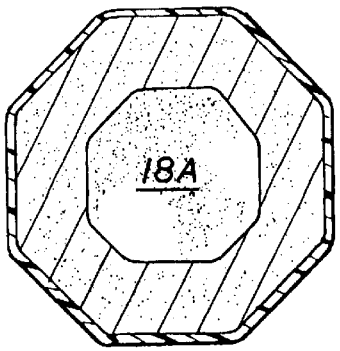
FIG. 5

VACUUM LYSIMETER GOLF CLUB HANDLE

CROSS-REFERENCE TO RELATED APPLICATION

This application is based on Provisional Application Ser. No. 60/036,984, filed on Jan. 30, 1997. Entitled "Vacuum Lysimeter Golf Club Handle".

BACKGROUND OF THE INVENTION

1. Field of the Invention

The present invention relates to grips for articles and more particularly relates to grips for sporting goods, tools and the like which grips includes an integral system for continuously extracting moisture from the surface of the grip during use.

Many articles have a grip which is intended to be grasped or held in the hand of the user when using the article. During use of the article, the user's hand may perspire causing moisture to be deposited upon the surface of the grip which interferes with the user maintaining a firm grip This can result in loss of control impairing the effectiveness with which the user controls the article. While the present invention is described herein with reference to incorporation in a grip of a sports racquet such as a tennis racquet, racquetball racquet and the like, it will be appreciated that the invention is applicable to other types of grips such as tool grips, ball bats and the like. Accordingly, the term "grip" as used herein refers to any surface which is manually held or grasped when in use and as a result is subject to accumulation of moisture or perspiration which may detrimentally effect use of the article.

2. Description of the Prior Art

Various approaches can be found in prior art to the problem of maintaining a handle portion of an article in a dry condition.

U.S. Pat. No. 1,563,352 discloses a tennis racquet having a handle provided with a hollow chamber which contains a powder. A slidably removable disk is positioned over a bore within the side of the handle which enables the user to remove the powder in the central chamber.

U.S. Pat. No. 3,645,008 discloses a handle having a central chamber provided with passageways leading the handle to accept desiccant powder from the central chamber.

U.S. Pat. No. 4,533,139 describes a tennis racquet handle in which a cooling medium such as pressurized carbon dioxide gas is contained within the handle. The handle has passageways for the carbon dioxide to minimize perspiration slippage due to the cooling effect of the medium.

U.S. Pat. No. 4,890,848 shows a racquet handle and dispenser in which a magazine is contained in the upper part of the handle for containment of a desiccant. A plunger dispenses a portion of the desiccant powder about the upper portion of the handle and a second chamber has a second plunger and associated valve to dispense desiccant powder on the lower portion of the handle.

U.S. Pat. No. 5,397,123 shows a tennis racquet grip having a polyurethane layer bonded to a felt layer. A plurality of dimples are formed in the polyurethane layer which dimples extend through the felt layer. The racquet has air passages communicating with the dimples and perforations to minimize formation of perspiration and enhance cushioning.

U.S. Pat. No. 5,571,051 shows a grip similar to that shown in U.S. Pat. No. 5,397,123 in which the invention is applied to golf club having a grip which is spirally wound about the golf club shaft.

U.S. Pat. No. 5,624,116 shows a grip for a sports racquet having a thin layer of synthetic material and a porous backing such as felt. Longitudinal channels are formed in the synthetic layer to expose the backing so that moisture can pass directly into the backing material. The channels are coextensive with the grips so that when the grip is wound, a series of channels are presented along at least most of the length of the handle.

From the foregoing, it will be apparent there are various approaches to the problem of maintaining grips, particularly sports grips, in a dry condition during use. These approaches generally range from toweling the grip to use of desiccant material or the formation of some type of air passages or moisture collection channels in the grip. Incorporation of moisture collection channels, use of special wraps, powders and desiccants will, to some extent, alleviate the problem of moisture build-up. However, these approaches are at best temporary and in some cases can only be utilized during interruptions in use or play. Further, wraps and powders require replacement from time-to-time and are therefore expensive. The present invention utilizes technology which will work continuously both during periods of use and play.

BRIEF SUMMARY OF THE INVENTION

The present invention provides a grip having an internal vacuum chamber which may be evacuated to maintain a negative pressure within the grip for a substantial period of time. The vacuum will cause moisture to be extracted from the outer grip surface to maintain the grip free of moisture build-up for the period of use or play.

The invention utilizes the principle of a vacuum lysimeter which has been developed in the field of soil physics. Researchers in the field of soil physics have recognized that soil waters are tightly bound to soil particles by adhesion. In order to strip away this water, a force greater than the force bonding the water to the soil is required. A device termed a "suction or vacuum lysimeter" was developed to accomplish this function. The suction lysimeter employs a porous material surrounding an internal vacuum chamber. When the porous material is wetted and a vacuum applied to the chamber, a hydraulic gradient is established and, as a result, water or moisture in contact with the outer surface of the suction lysimeter is drawn inward through the porous material into the vacuum chamber. The rate at which water or moisture is drawn in is a function of pore size, the communication between the pores (permeability), the magnitude of the vacuum and the availability of water on the surface of the device.

The present invention provides a grip or handle for a sports racquet, golf club, tool or other article which has a grip having one or more internally formed collection chambers. Passageways, which may be slots or perforations, extend through the grip area communicating with the internal vacuum chambers. The passageways are covered or filled with a material having both pre-determined porosity and permeability. The material may be hydrophilic, for example, ceramic, glass or stainless steel or hydrophobic such as PTFE. A port communicating with the chamber is provided at a suitable location such as at the end of the grip and is closed by a removable plug. The plug defines an opening or conduit in which is installed an air extraction valve. A covering may be wrapped or molded around the porous material to provide cushioning and also to provide a repository for moisture build-up. When the grip is wetted and a vacuum is applied to the chamber, moisture will be drawn by a wicking action into the internal chamber.

Accordingly, the present invention provides a grip with moisture removing capability which has the following advantages:

1) The grip will remain free of moisture or perspiration build-up on the surface during use.

2) The grip allows the user to maintain a firm grasp preventing inadvertent slippage or loss of control of the article during use.

3) When the invention is applied to sports racquets such as a tennis racquet, ball striking is improved and any inadvertent and possibly dangerous slippage or release of the racquet is minimized.

4) The grip of the present invention is strong, lightweight and remains dry during use and can be incorporated into the article at minimal cost increase.

BRIEF DESCRIPTION OF THE DRAWINGS

The above and other objects of the present invention will become more apparent from the following description, claims and drawings in which:

FIG. 1 is a top view of the representative item incorporating the moisture removing means of the present invention, in this case a sports racquet;

FIG. 2 is a longitudinal cross-sectional view of a portion of the handle and grip taken along line 2—2 of FIG. 1;

FIG. 3 is a cross-sectional view taken along lines 3—3 of FIG. 2;

FIG. 5 is a cross sectional view taken along line 5—5 of FIG. 4;

FIG. 6 is a cross sectional view taken along line 6—6 of FIG. 4;

DETAILED DESCRIPTION OF THE INVENTION

Figure 4:
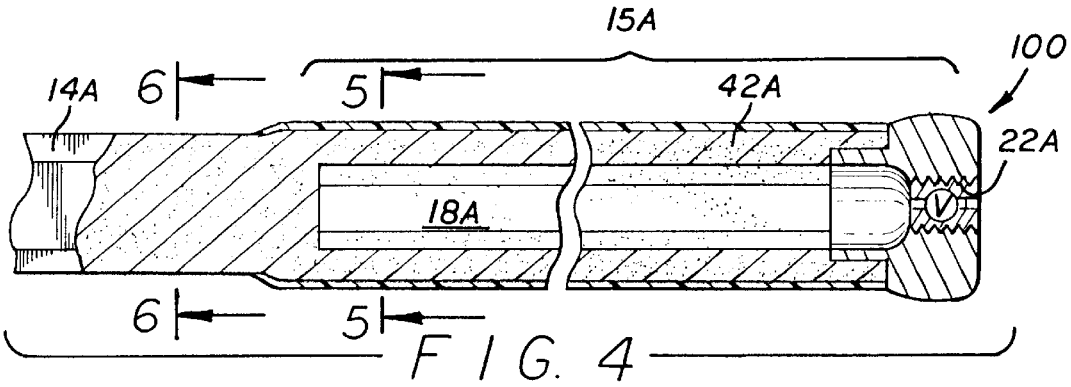
FIG. 4 is a longitudinal cross-sectional view of an alternate embodiment of the present invention.

Referring now to the drawings, particularly FIG. 1 to 3, a preferred embodiment of the present invention incorporating the inventive concept is shown in connection with a racquet 10 which has a conventional racquet head 12 and a handle 14. Handle 14 is elongated and having a grip area 15 which may be easily grasped by the user. The grip 15 may be of any suitable size and cross-sectional shape and for purposes of illustration is shown as octagonal. The handle 14 may be fabricated of any suitable material such as wood, metal plastic or a composite material. The handle has a rear or butt end 16 which may be integrally formed as part of the handle or may be formed by an insert member.

An internal chamber 18 extends longitudinally within the grip area 15 from the end of the handle and has a length corresponding at least to approximately to the length of the grip area 15. Typically for an article such as a tennis racquet, the chamber will extend approximately 4" to 8' inches longitudinally within the handle.

A cap 16 at the end of the handle defines an opening or passageway 22 which defines threads 24. A removable plug 26 is in threaded engagement with threads in the end of the handle so that the plug may be removed to access the chamber 18. Plug 26 may be any suitable material such as plastic or metal.

Figure 8:
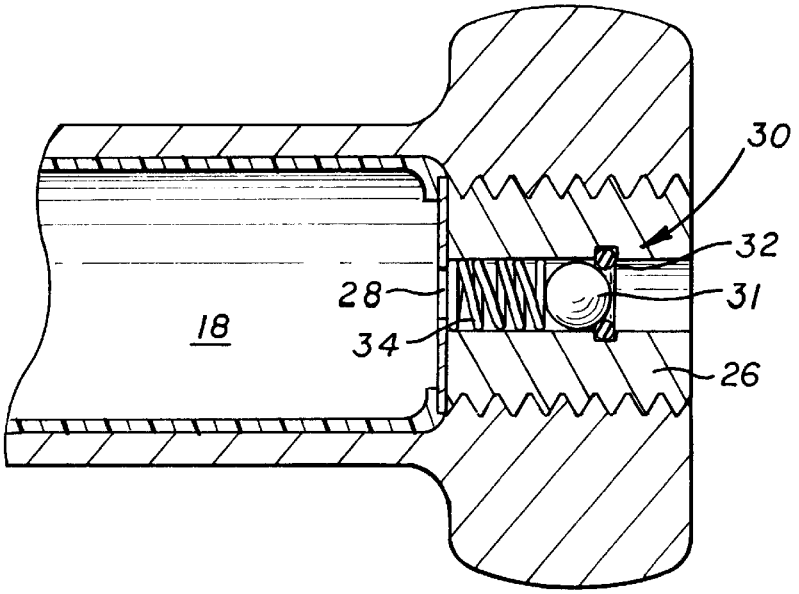
FIG. 8 is a detail of the ball check valve.

As best seen in FIG. 8, concentrically disposed within the plug is axially extending opening or conduit 28. Located within the conduit 28 is air extraction valve 30. The air extraction valve is shown in FIG. 8 and is a ball check valve having a ball 31 which is spring biased against seat 32 by spring 34. The spring will maintain the ball 31 seated in the closed position to prevent ambient air from entering chamber 18. Other types of valves can be used to allow air to be extracted from the chamber 18, for example, a septum-like valve of the type used to inflate footballs and basketballs will also work.

Handle 14 defines a plurality of perforations 40 in the grip area. The perforations 40 may be in the form of radially extending holes at spaced apart locations as shown in FIG. 2. Alternatively, the perforations may be peripherally spaced, longitudinally extending slots in the grip area 15. The outer surface of the grip and the perforations are covered with a porous material 42. As shown, the porous material 42 extends along both the inner surface and outer surface of the grip filling or covering the various perforations 42. The porous material preferably has pores which have a size of between approximately 1 to 50 microns, although pore sizes at the lower end of this range have been found to work best.

Communication between the pores must allow passage of moisture. This communication is termed "permeability". When the pores and microscopic passages communicating the pores are filled with fluid, the adhesion between the fluid and the walls of the pores effectively blocks the passageways and prevents air entry. When the magnitude of the vacuum becomes very large, (it cannot exceed one atmosphere) depending on the pore-liquid tension, air entry may occur, thus causing the device to malfunction. The ability of a porous material to withstand an applied suction is determined by its bubbling pressure. The bubbling pressure is measured by saturating the porous material, immersing it in water, and pressurizing the inside of the device with air. The pressure at which air starts bubbling through the porous material into the surrounding water is the bubbling pressure. This test has the advantage that materials such as porous ceramics with very high bubbling pressures can be tested, therein, in excess of one atmosphere (14.7 psi). The magnitude of the bubbling pressure is equal to the magnitude of the maximum suction which can be applied to the wetted porous material before air entry occurs. Given that the maximum vacuum that can be applied is one atmosphere, this means that, in theory, the device could remove liquids held in the grip by tension up to one bar. It is preferred that the material 42 have a bubbling pressure approximately in the range of 4 to 20 psi.

The porous material may be a ceramic such as the material sold under the designation "One Bar High Flow Ceramic" by Soil Moisture Equipment Corporation of Santa Barbara, Calif. Expanded PTFE, stainless steel or even porous plastic having the proper characteristics may be used. The material must have a pore size in the range specified to properly function in the manner of a vacuum lysimeter as has been set forth above. The materials may be a hydrophilic or hydrophobic material with permeability having the characteristics that when the porous material is wetted and a vacuum applied to the internal chamber any water in contact with the outer surface will be drawn inwardly through the pores to the internal vacuum chamber.

Extending about the grip area and about the porous material is a wrap 44. The wrap 44 may be either applied as a covering or may be tightly molded around the material to provide resilience for the comfort of the user and to provide a repository for accumulation of moisture. The wrap may be any suitable natural or synthetic material, such as rubber with polyurethane being preferred. The material shown in U.S. Pat. No. 5,238,620 is suitable for this purpose.

FIG. 4 shows a cross-section of a grip incorporating an alternate embodiment of the invention designated by the numeral 100. In this embodiment, the entire grip area 15A is a molded porous material having the characteristics described above to function as the suction lysimeter. The material is hydrophilic or hydrophobic having pores which range in size from about 1 to 50 microns it being preferred that the pore size are substantially uniform in size. The grip surrounds an internal vacuum chamber 18A which is closed at one end by a suitable plug 22A. The advantage of the embodiment of FIG. 4 is that the grip can be molded as an integral unit from a material having suitable strength and mechanical characteristics to serve as a grip and also having the proper structure to extract moisture from the exterior surface. The invention will be more fully understood from the following description of use.

Figure 7:
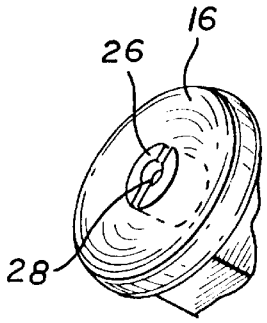
FIG. 7 is a perspective detail view of the butt end of the racquet shown in FIGS. 2 and 4.

Referring to FIGS. 1, 2, and 7, on hot, humid days when perspiration presents a problem, the grip as described above is activated by first wetting the material 42 to charge the pores of the material with fluid. A vacuum is then applied to the vacuum chamber 18 by connecting a suitable vacuum pump to the valve 28. The vacuum pump can be a manually operated pump or may be a vacuum pump employing a small motor. The vacuum in the chamber is applied until the vacuum is approximately 80 centibars. In use, as moisture accumulates on the surface 44, it is wicked inwardly through the porous material by the vacuum in the vacuum chamber. When the moisture reaches the vacuum chamber 18, it will accumulate on the internal walls of the vacuum chamber as a thin film and eventually water droplets will form and collect as free water within the chamber 18.

Sometimes, depending on the humidity and the rate at which moisture is accumulated on the grip, the vacuum chamber 18 will require emptying. This can be accomplished by removing the plug 26 by rotating it to disengage the cooperating threads. Once disengaged, the internal chamber 18 can be emptied of accumulated moisture. The plug 26 is then replaced and the unit recharged by again applying a vacuum to chamber 18 in order to return the device to its original high level of performance.

It will be appreciated that the present invention can be applied to grips of all types and is not limited to use in connection with sports racquets and sports clubs. For example, in addition to sports racquets and clubs, the invention is applicable to devices such as ball bats, tool handles, and industrial hand grips of various types. The present invention substantially diminishes the build-up of moisture on the handle of the grip which will, in turn, provide more positive, safer control. In the case of a sports racquet, the invention will improve control minimizing mis-hit shots and assist in preventing the player from losing his or her grip on the handle which may otherwise be inadvertently released, damaging the racquet and presenting a hazard to individuals in the area.

The present invention is entirely passive once the vacuum chamber has been charged. Any moisture on the handle is wicked inwardly through the microscopic pores of the porous material into the vacuum chamber. The invention involves no moving parts or chemicals and uses lightweight materials. The vacuum can easily and conveniently be applied by using a portable lightweight hand pump or an electrically operated pump. Once moisture collects within the vacuum chamber, it can be easily extracted by removing the air extraction liquid removal plug and emptying the contents of the vacuum chamber. Recharging is easily accomplished as described above.

It will be obvious to those skilled in the art to make various changes, alterations and modifications to the invention described herein. To the extent those various changes, alterations and modifications do not depart from the spirit and scope of the appended claims, they are intended to be encompassed therein.

I claim:

1. A grip for an article adapted to be manually grasped by user, said grip comprising:

a) an elongated body having an external surface and defining an internal chamber, said internal chamber having an internal surface;

b) said body defining at least one passageway extending through said body to said chamber and communicating said chamber with the ambient environment;

c) a porous material extending across said passageway, said porous material being permeable;

d) said body defining a port communicating with said chamber;

e) a removable plug in said port; and f) valve means in said grip for selectively extracting air from said chamber to impose a vacuum therein.

2. The grip of claim 1 wherein said body defines a plurality of said passageways.

3. The grip of claim 1 wherein said porous material is selected from the group consisting of ceramics, glass, stainless steel or PTFE.

4. The grip of claim 1 wherein said handle has a butt-end and said port is provided in said butt-end.

5. The grip of claim 1 wherein said article is a sports racquet.

6. The grip of claim 1 wherein said grip is a tool grip.

7. The grip of claim 1 wherein said grip is for a sports club.

8. The grip of claim 7 wherein said porous material has a pore size in the range of approximately 1 to 50 microns.

9. The grip of claim 1 wherein said passageway comprise a plurality of holes.

10. The grip of claim 1 wherein said passageway comprises a plurality of slots.

11. The grip of claim 1 wherein said material has a bubbling pressure of approximately 4 to 20 psi.

12. A grip for an article adapted to be manually grasped by the user, said grip comprising:

a) an elongated body having an external surface and defining an internal chamber;

b) said body being of a material defining pores and having a predetermined permeability;

c) a port in said body extending from said external surface to said internal chamber; and d) valve means in said grip to permit selective imposition of a vacuum in said chamber.

13. A method of maintaining a grip for an article which is adapted to be grasped by user in a dry condition, said method comprising:

a) providing an internal chamber with said grip;

b) providing at least one passageway communicating said internal chamber with ambient surroundings;

c) covering said passageway with a porous material having a predetermined permeability and;

d) applying a vacuum to said internal chamber creating a wicking effect inward from the surface of said grip into the vacuum chamber causing moisture to migrate into said vacuum chamber.

14. The method of claim 13 further including the steps of periodically opening said vacuum chamber and removing any moisture collected therein and thereafter re-establishing the vacuum in said chamber.

* * * * *